US005237775A

United States Patent [19]

Hardy

[11] Patent Number: 5,237,775

[45] Date of Patent: Aug. 24, 1993

[54] SLIDING MECHANISM FOR WINDOW CONSTRUCTIONS

[75] Inventor: Terence Hardy, Nether Heage, England

[73] Assignee: L.B. Plastics Limited, Derbyshire, England

[21] Appl. No.: 998,524

[22] Filed: Dec. 30, 1992

Related U.S. Application Data

[63] Continuation of Ser. No. 979,462, Nov. 20, 1992, which is a continuation of Ser. No. 709,620, Jun. 3, 1991, abandoned.

[30] Foreign Application Priority Data

Sep. 11, 1990 [GB] United Kingdom ..... 9019788
Apr. 29, 1991 [GB] United Kingdom ..... 9109201

[51] Int. Cl.[5] ..... E05D 15/22
[52] U.S. Cl. ..... 49/181; 49/453
[58] Field of Search ..... 49/181, 453, 454

[56] References Cited

U.S. PATENT DOCUMENTS

| | | | |
|---|---|---|---|
| 3,482,354 | 12/1969 | Trout | 49/181 |
| 3,524,282 | 8/1970 | Kraft et al. | 49/181 |
| 3,789,549 | 2/1974 | Yip | 49/181 |
| 4,364,199 | 12/1982 | Johnson et al. | 49/181 |
| 4,581,850 | 4/1986 | Simpson | 49/181 |
| 4,590,708 | 5/1986 | Campodonico | 49/181 |
| 4,718,194 | 1/1988 | Fitzgibbon et al. | 49/181 |
| 4,930,254 | 6/1990 | Valentin | 49/181 |
| 4,958,462 | 9/1990 | Cross | 49/181 |

FOREIGN PATENT DOCUMENTS

| | | |
|---|---|---|
| 1,388,819 | 1/1972 | U.K. |
| 1,508,600 | 4/1975 | U.K. |
| 1,508,601 | 1/1975 | U.K. |
| 1,364,484 | 6/1971 | U.K. |
| 9019788.0 | | U.K. |
| 9109201.5 | | U.K. |

*Primary Examiner*—Philip C. Kannan
*Attorney, Agent, or Firm*—W. Thad Adams, III

[57] ABSTRACT

A sash window construction comprises an outer frame, at least one sash frame supported for sliding movement relative to the outer frame by locating members on the sash frame engageable with carrier members located in channels formed in the outer frame, components of the carrier members being movable between operative positions in which the carrier members are slidable in the channels and the sash frame is secured against release from the main frame, and release positions in which the carrier members are locked against sliding movement and the sash frame may be disengaged from the outer frame. Preferably the sash frame is arranged to be tiltable relative to the main frame, being retained against engagement in its normal position of use and removable from the main frame in its tilted position.

5 Claims, 3 Drawing Sheets

SLIDING MECHANISM FOR WINDOW CONSTRUCTIONS

This application is a continuation application of U.S. Ser. No. 979,462 filed Nov. 20, 1992 which is a continuation of U.S. Ser. No. 709,620 filed Jun. 3, 1991, now abandoned.

This invention relates to window constructions and especially to sliding mechanisms for use with sliding sash windows.

Modern sliding sash windows, in addition to incorporating means to permit sliding movement of at least one sash frame relative to an outer frame, include means permitting tilting of the sash frame out of its normal vertical position to an inclined or horizontal position. This enables insertion of the sash frame into the outer frame during assembly of the window and also facilitates cleaning of the window once installed. For this purpose pivot blocks are slidably mounted in channels in the sides of the outer frame and are engaged by pivot arms mounted on the sash frame. The pivot blocks are connected to spring balance assemblies housed within the channels in the outer frame to facilitate raising and lowering of the sash frame during use. Generally such window constructions incorporate a pair of sash frames mounted in parallel tracks in the outer frame and slidable relative to the outer frame and to one another.

While previously proposed sash window constructions of this kind operate satisfactorily during use, they give rise to a number of problems during assembly or if the sash frames require to be removed from the main frame for repair or replacement. For safety reasons the pivot blocks are generally arranged to expand and lock against sliding movement in the channels in the outer frame when the sash frame is tilted out of its normal vertical plane. This ensures that the sash frame cannot slide relative to the outer frame except in its normal position of use. In order to install or remove the sash frame it has hitherto been necessary to tilt it to a position in which the pivot blocks are locked against sliding movement and then disconnect the pivot bars from the frame to enable removal. The pivot bars then require to be re-connected during re-assembly. This is a time consuming operation and involves the use of screws or similar fastening means which can readily be mislaid.

In order to avoid the need to disconnect the pivot bars from the sash frame in this way installers habitually force the frames into and out of the main frame. For this purpose the sash frame is forcibly misaligned in the main frame by raising one side relative to the other until it is possible to dis-engage the pivot bar at one side from the associated pivot block and thereby release the sash frame without disconnecting the pivot bar. Apart from the fact that this causes damage both to the main frame and to the sash frame, the sash frame can only be twisted out of its properly aligned position while the slide blocks can slide along the channels in the main frame and if the sash frame springs out of the main frame before the sash frame has been tilted to lock the slide blocks in their channels, the balance springs will retract the slide blocks to their uppermost position from where it can be extremely difficult to retrieve them for subsequent re-engagement with the sash frame.

It is an object of the present invention to provide a sliding sash window construction in which these difficulties are obviated or mitigated.

The invention provides a sash window construction comprising an outer frame, at least one sash frame supported for sliding movement relative to said outer frame by locating members on the sash frame engageable with carrier members located in channels formed in said outer frame, components of said carrier members being movable between operative positions in which the carrier members are slidable in said channels and said locating members are secured against disengagement from said carrier members, and release positions in which said carrier members are locked against sliding movement and said locating members may be disengaged from said carrier members to release said sash frame from said outer frame.

Preferably said movable components of said carrier members are rotatable to permit tilting movement of said sash frame relative to said outer frame, said carrier members being in their locked positions when said sash frame is in its tilted position. Preferably also said locating members are engaged with said rotatable components of said carrier members whereby movement of said sash frame from its normal position of use to its tiled position rotates said components between their operative and release positions.

Said carrier members preferably comprise slide blocks connected to spring means housed within said channels to facilitate sliding movement of the sash frame relative to the main frame.

Preferably each of said rotatable components comprises a cam member engageable by an associated locating member on said sash frame, the cam member serving on rotation of the sash frame out of the plane of the main frame to expand the slide block and lock same against sliding movement along the associated channel in the main frame.

Preferably said cam member incorporates an elongated slot engageable by said locating member, said slot being arranged transversely to said channel when the sash frame is in its normal position of use and being aligned with said channel when the sash frame is tilted through 90° relative to the main frame to permit the locating member and said sash frame to be lifted clear of the slide block and disengaged from said main frame.

Preferably also each locating member on said sash frame incorporates a projection engageable with said slot in said cam member, said projection having a neck portion the width of which is less than the width of the entrance to the associated channel in the main frame, and a head portion of increased width but of a thickness less than the width of said entrance, whereby following release of the sash frame from the associated slide blocks the frame may be tilted to enable the head portion of the locating member at one side to pass through the associated entrance in the main frame, thereby enabling the sash frame to be drawn clear of the main frame.

Each of said locating members is preferably of L-shaped cross-section adapted to be fitted to a corner of the sash frame. Advantageously the arms of the L-shaped locating member are dimensioned to seat snuggly in channels formed in the outer edges of the sash frame whereby to retain the locating member securely against twisting or other movement during use.

An embodiment of the invention will now be described, by way of example only, with reference to the accompanying diagrammatic drawings, in which.

Figure 1:
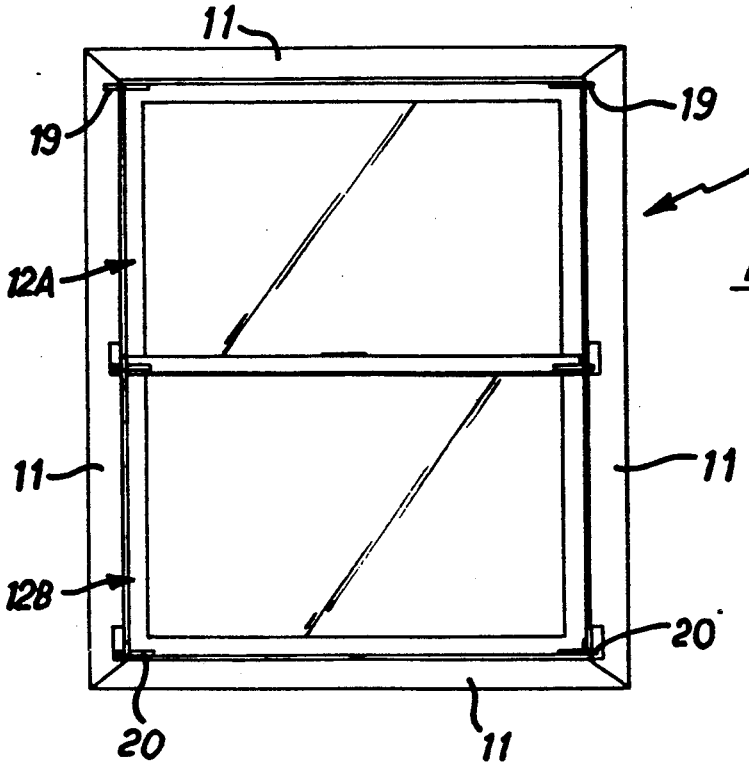
FIG. 1 is a front elevation of a sliding sash window construction.

Referring to FIG. 1, there is shown a sliding sash window assembly comprising an outer frame 10 consisting of top, bottom and side frame members 11 of identical cross-section secured together at their corners by welding. Upper and lower sash frames 12A and 12B are slidably mounted in the main frame 10 by engagement with parallel channels formed in the side frame members 11, the sash frames being vertically slidable in the associated channels relative to the main frame and to one another. The sash frames are engaged with the channels in the outer frame by means of locating members 20 at their lower corners and are retained against pivotal movement during normal use by sliding latch members 19 at their top corners.

Figure 2:
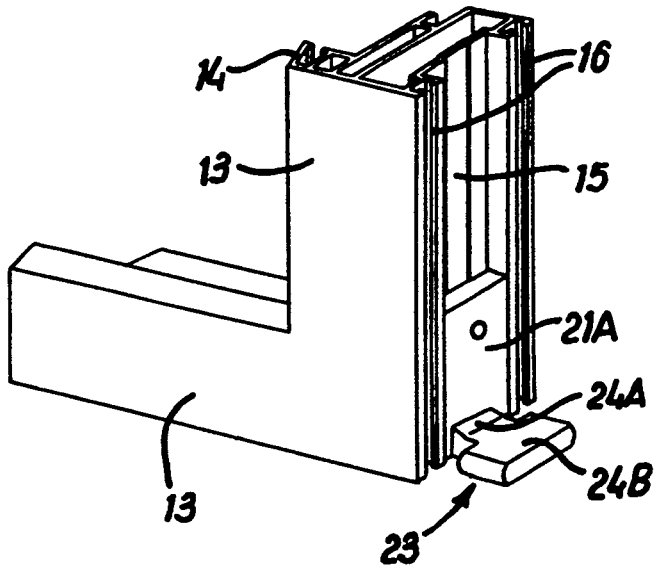
FIG. 2 is a fragmentary perspective view of one lower corner of a sash frame incorporated in the window of FIG. 1.

FIG. 2 of the drawings shows the lower corner of one of the sash frames. The frame is formed from top, bottom and side frame members 13 of identical construction secured together at their corners by welding, portions of the bottom frame member and one side frame member only being shown in FIG. 2. Inwardly projecting formations 14 on the frame members provide seatings for a glazing unit which may be retained in position by removable glazing beads, not shown, in known manner. The outer faces of the frame members 13 are provided with central channels or recesses 15 and outer channels 16, the channels 16 being adapted to receive flexible sealing members (not shown) engageable with adjacent surfaces of the outer frame to provide a weatherproof seal.

Figure 3:
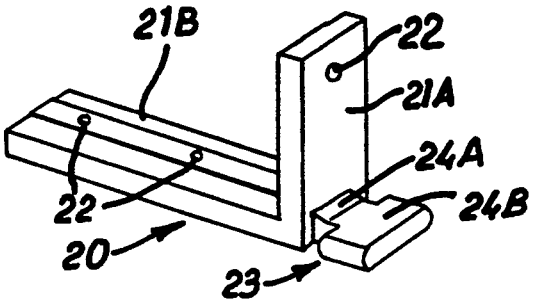
FIG. 3 is a perspective view of a locating member adapted to be mounted at the lower corner of each sash frame.

A locating member 20 shown in FIG. 3 of the drawings is mounted at each lower corner of each of the sash frames 12A and 12B and serves to connect the sash frames to the outer frame 11 in a manner which will be described hereafter. Each locating member is of generally L-shaped cross-section having arms 21A and 21B arranged at right angles to one another and provided with screw holes 22 enabling the locating member to be secured to the associated corner of the sash frame by screws or similar fastenings. A projection 23 extends outwardly from the upright arm 21A of the pivot member and comprises a narrow neck portion 24A terminating in a wider generally flat head portion 24B.

Figure 4:
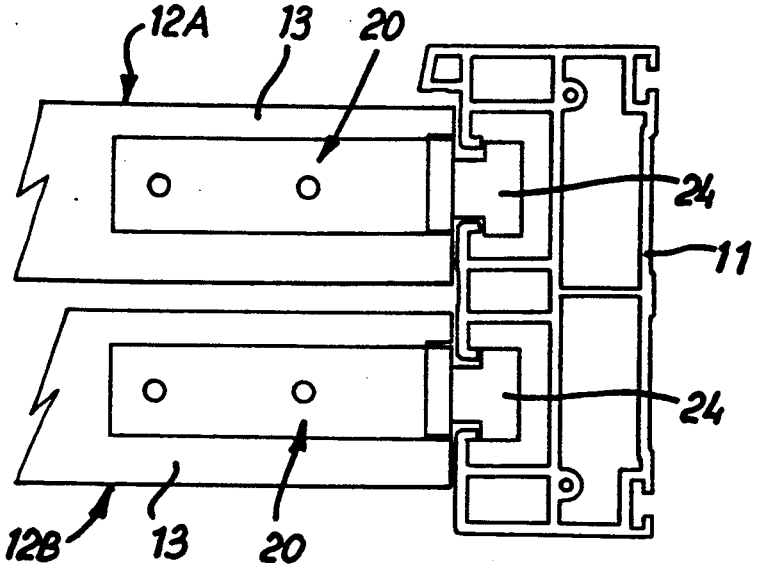
FIG. 4 is a diagram showing the sash frames engaged with the main frame but with parts omitted for clarity.
Figure 8:
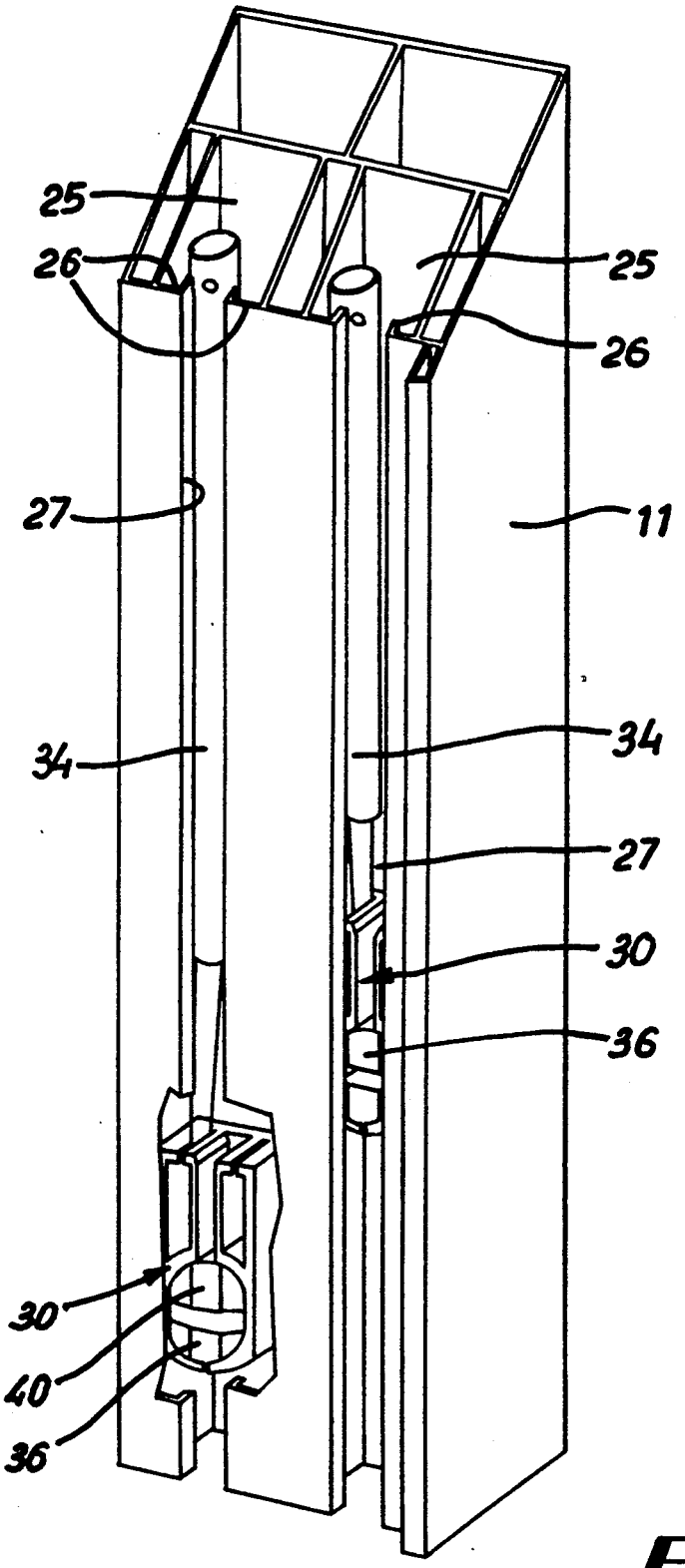
FIG. 8 is a part fragmentary perspective view of a portion of the main frame of the window construction showing the slide blocks in position.

The projection 23 is engageable with a slide block 30 slidably retained within the adjacent side frame member 11 of the outer frame 10 as shown in FIG. 8 of the drawings. For this purpose the outer frame member 11 incorporates parallel channels 25 each provided with projecting lips 26 defining a narrow elongated entrance 27 through which the associated projection 23 extends into engagement with the slide block 30. The width of the neck portion 24A of the projection 23 is less than the width of the opening 27 and the thickness of the head portion 24 is also less than the width of the opening 27. The locating member may therefore be engaged with the channel 25 by tilting the sash frame to enable the head 24B to pass through the opening 27 and then rotating it through 90 degrees when it adopts the position shown in FIG. 4 of the drawings in which the head portion 24B extends across and prevents disengagement from the channel 25 and the neck 24A slides along the opening 27 during opening and closing movement of the sash frame. FIG. 4 of the drawings is diagrammatic in that it does not disclose the slide blocks 30 now to be described.

Figure 5:
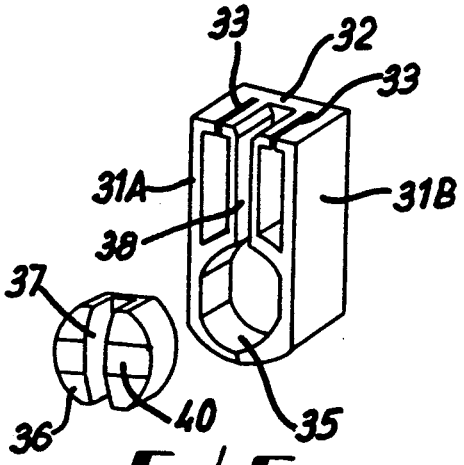
FIG. 5 is an exploded perspective view of a slide block slidably engageable with the main frame of the window.

Each of the channels 25 in the opposite side frame members 11 of the outer frame 10 has a carrier member in the form of slide block 30 slidably located therein, the blocks 30 in one pair of channels being engaged by the locating members 20 at opposite corners of the upper sash frame 12A and the blocks 30 in the other pair of channels being engaged by the locating members at the bottom corners of the lower sash frame 12B. As best seen in FIG. 5 of the drawings, each slide block comprises a body member 31 comprised of identical halves 31A and 31B flexibly interconnected at their upper region by a hinge portion 32. Slots 33 formed in the upper edges of the side portions 31A and 31B are adapted for engagement by balance spring mechanisms shown at 34 in FIG. 8.

Figure 6:
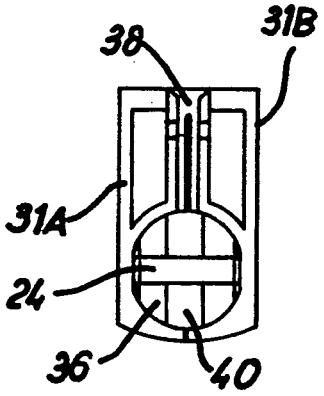
FIGS. 6 and 7 are diagrams showing the slide block in alternative positions of use.
Figure 7:
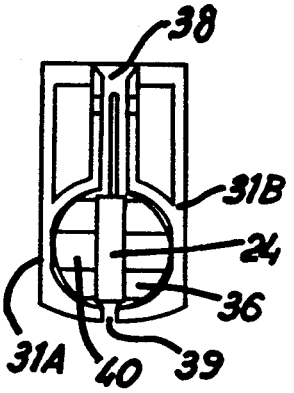

A generally cylindrical but non-circular opening in the form of a blind recess 35 is formed in the lower portion of the slide block 30 and is adapted to receive a cam member 36 having a central slot 37 and dimensioned such that in a first position shown in FIG. 6 of the drawings the cam member sits freely in the opening 35 thereby allowing the block to slide along the associated channel 25, and in a second position shown in FIG. 7 of the drawings, the cam member is rotated through 90° and forces the two halves 31A and 31B of the block apart to an extent limited by the sides of the channel 25, thereby locking the block against sliding movement along the channel. A raised central portion 40 is formed on the cam member at right angles to the slot 37 such that when the cam member is in the position of FIG. 7, the portion 40 engages the inner edges of the lips 26 and wedges the cam member between the lips and the opposite wall of the channel 25 to provide further resistance to sliding movement of the block 31.

When the cam member is in its sliding position the slot 37 extends horizontally. In the locked position the slot 37 extends vertically and aligns with a slot 38 formed between the two parts 31A and 31B of the slide block such that the slots 37 and 38 together form a channel in the slide block open at its upper end but closed at its lower end due to the gap 39 created between the two parts 31A and 31B being less than the widths of the slot 37 and channel 38. When the sash frames are engaged with the main frame the head portion 24A of each projection 23 engages in the slot 37 of the associated cam member and adopts the position shown in FIG. 6 such that during opening and closing movements of the sash frame the slide blocks slide along the associated channels 25 in the main frame under the influence of the balance spring assemblies 34.

When the window is assembled at the factory, the sash frames are fitted to the outer frame and the assembled window is delivered to site in this form. On site the sash frames are removed, the outer frame fitted to the building and the sash frames re-fitted. Removal and re-fitting of the sash frames may readily be effected by retracting the latch members 19 from engagement with the channels 25 in the outer frame and swinging each sash frame in turn into a position at right angles to the main frame. This rotates the cam members 36 into the position shown in FIG. 7 and locks the slide blocks 30 against sliding movement. The head portions 24B of the locating members 20 may then be disengaged from the slide blocks by sliding them out of the vertically disposed slots in the cam members 36 and through the slots 38. The sash frame can then be tilted to allow the head portions to pass through the openings 27 and release the sash frame from the outer frame. After fitting of the outer frame to the building the sash frames are re-fitted by reversing the procedure.

During normal operation of the window the slide blocks 30 move freely along the channels 25 and the balance spring assemblies 34 retain the sash frames in any intermediate vertical positions between their upper and lower positions. The head portions 24 of the locating members extend behind the lips 26 of the channels 25 and thereby restrain the sash frames against excessive lateral movement during sliding. This also serves to ensure that in event of the main frame becoming buckled the sash frames could not become disengaged from the main frame at one side.

The arrangement described greatly facilitates initial assembly and subsequent removal and replacement of the sash frames without requiring parts to be unscrewed or otherwise disassembled and without deforming or twisting components as has commonly been done hitherto.

Various modifications may be made without departing from the invention. For example the construction of the main frame and sash frames may differ substantially from that described and modified forms of slide block and locating member may be employed. Moreover while in the arrangement described the window incorporates two vertically slidable sash frames, the sash frames may be horizontally slidable and only one or more than two such frames may be provided. The arrangement illustrated is however the more common construction.

I claim:

1. A sash window construction comprising an outer frame, at least one sash frame supported for sliding and tilting movement relative to said outer frame by locating members on the sash frame engageable with carrier members located in channels formed in said outer frame, said carrier members comprising slide blocks connected to spring means housed within said channels to facilitate vertical sliding movement of the sash frame relative to the main frame, said locating members being engaged with rotatable components of said slide blocks whereby movement of said sash frame from its normal vertically slidable position of use to its tilted position rotates said components between first positions in which said slide blocks are slidable in said channels and second positions in which said slide blocks are locked against sliding movement, each of said rotatable components comprising a cam member incorporating an elongated slot engageable by the associated locating member, said slot being arranged transversely to said channel when the sash frame is in said normal position and being aligned with said channel when the sash frame is moved to said tilted position, in which position the locating members and sash frame may be lifted clear of the associated slide blocks and disengaged from said main frame, each of said slide blocks being formed in two portions flexibly connected at their upper ends and separated at their lower ends whereby the latter move apart on rotation of the sash frame to said tilted position to lock the slide block in the associated channel in the main frame, said slide block extending upwardly above said cam member, and the upper portion of said block including a further slot extending parallel to said channel and adapted to align with the slot in said cam member when the latter is in its vertical position, the arrangement being such that the locating members on the sash frame may only be disengaged from the associated slide blocks in an upward direction.

2. A sash window construction according to claim 1 wherein each of said channels is provided with inwardly directed lips defining a narrow entrance thereto, each locating member on said sash frame incorporates a projection engageable with said slot in said cam member, said projection having a neck portion the width of which is less than the width of the entrance to the associated channel in the main frame, and a head portion of increased width but of a thickness less than the width of said entrance, whereby following release of the sash frame from the associated slide blocks, the frame may be tilted to enable the head portion of the locating member at one side to pass through the entrance to the associated channel in the main frame, thereby enabling the sash frame to be drawn clear of the main frame.

3. A sash window construction according to claim 1 wherein each of said locating members is of L-shaped cross-section adapted to be fitted to a corner of the sash frame.

4. A sash window construction according to claim 3 wherein the arms of the L-shaped locating member are dimensioned to seat snugly in channels formed in the outer edges of the sash frame whereby to retain the locating member securely against twisting or other movement during use.

5. For use with a sliding sash window construction, a slide block assembly adapted to be mounted for sliding movement in a channel formed in an outer frame of the window and comprising a body member comprising hingedly interconnected components flexibly connected at their upper ends and separated at their lower ends, a cam member rotatably mounted within the body member between said components and operable on rotation to move the components apart to expand said body member and lock the slide block against sliding movement along the associated channel in the main frame, a recess in the form of a slot formed in said cam member to receive a locating member attached to a sash frame, said recess being closed to retain said locating member in engagement with the assembly when said body member is in its unexpanded condition and being open to permit disengagement of said locating member when said body member is in its expanded condition, said body member extending upwardly above said cam member, and the upper portion of said body member including a further slot extending between said cam member and the upper end of the body member, said further slot being adapted to align with said slot in the cam member when the body member is in its expanded condition, whereby to form a passage through the body member permitting disengagement of said locating member from the slide block assembly in an upward direction.

* * * * *